US005970594A

United States Patent [19]

Borsi et al.

[11] Patent Number: 5,970,594

[45] Date of Patent: Oct. 26, 1999

[54] METHOD TO ROLL STRIP AND PLATE AND ROLLING LINE WHICH PERFORMS SUCH METHOD

[75] Inventors: Roberto Borsi, Udine; Fabio Fasoli, Acquasparta, both of Italy

[73] Assignee: Danieli & C. Officine Meccaniche SpA, Buttrio, Italy

[21] Appl. No.: 08/736,696

[22] Filed: Oct. 25, 1996

[30] Foreign Application Priority Data

Oct. 27, 1995 [IT] Italy ..... UD95A0215

[51] Int. Cl.[6] ..... B23P 17/00

[52] U.S. Cl. ..... 29/81.08; 29/527.7

[58] Field of Search ..... 29/527.7, 81.08, 29/33 C; 164/460, 483

[56] References Cited

U.S. PATENT DOCUMENTS

| | | | |
|---|---|---|---|
| 3,478,808 | 11/1969 | Adams et al. . | |
| 4,920,899 | 5/1990 | Blundy et al. | 110/336 |
| 5,490,315 | 2/1996 | Kostopolos et al. | 29/527.7 |
| 5,542,165 | 8/1996 | Coassin et al. | 29/527.7 X |
| 5,689,991 | 11/1997 | Kircher | 29/527.7 X |

FOREIGN PATENT DOCUMENTS

| | | |
|---|---|---|
| 438066 | 7/1991 | European Pat. Off. . |
| 0499851 | 8/1992 | European Pat. Off. . |
| 0625383 | 11/1994 | European Pat. Off. . |
| 674952 | 10/1995 | European Pat. Off. . |
| 4017928 | 12/1991 | Germany . |
| 4137547 | 5/1993 | Germany . |

OTHER PUBLICATIONS

Patent Abstracts of Japan, vol. 14, No. 351 (M–1003) Jul. 30, 1990 & JP–A–02 121714 (Nippon Steel) May 9, 1990 abstract.

*Primary Examiner*—David P. Bryant

*Attorney, Agent, or Firm*—Antonelli, Terry, Stout & Kraus, LLP

[57] ABSTRACT

Method and line to roll strip and plate starting from thin slabs produced by continuous casting, whereby the cast product is subjected to at least one descaling operation followed by a roughing operation and by a finishing operation before being wound in coils, thin slabs being cast continuously at the same time by a continuous casting machine with at least one casting line (11), the thin slabs being then sheared to size to obtain segments of the desired length, the segments then undergoing a first descaling step and then being accelerated into the heating furnace (18) consisting of modules and then to a second descaling unit (21) and then through a roughing rolling mill stand (22), before being delivered to a tunnel furnace (24), a third descaling unit (27) and a finishing train (12).

12 Claims, 1 Drawing Sheet

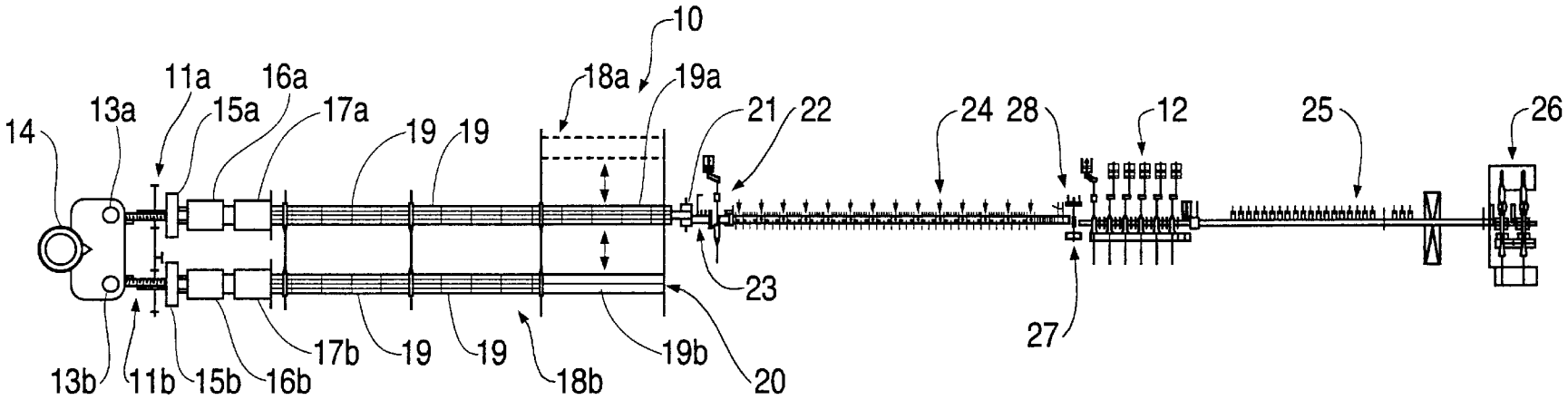
26
25
12
27
28
24
22
21
23
20
10
19a
19b
18a
18b
19
19
19
19
17a
17b
16a
16b
15a
15b
11a
11b
13a
13b
14

METHOD TO ROLL STRIP AND PLATE AND ROLLING LINE WHICH PERFORMS SUCH METHOD

BACKGROUND OF THE INVENTION

This invention concerns a method to roll strip and plate and the rolling line which performs this method.

To be more exact, the invention arranges to produce strip or plate by starting from thin slabs consisting of steel or of a metallic alloy and produced by means of continuous casting, thus obtaining a product of a high surface and internal quality.

Thin slabs to which the invention is applied have a thickness between 70 and 110 mm.

The rolling line according to the invention is able to tend a casting machine having at least one line.

In the case of two casting lines, they are fed at the same time, thus optimising the yield and efficiency of the plant and especially the yield of the rolling train.

In the field of rolling and, in particular, in the production of strip and/or plate, the problems are well known which are encountered by producers in obtaining a product of a high quality and in using at the same time a production line characterised by great functionality, versatility, good use of space and by fast and reduced times spent on corrective work for maintenance and replacement.

The state of the art also covers rolling lines, such as that in European patent application No. 95102881.0 for instance, which are fed alternately by two or more continuous casting machines; these lines normally include systems for transferring the products from the casting line or lines positioned offset from the rolling line.

The transfer systems are normally obtained with modular elements forming part of a furnace performing temperature maintenance and possible heating of the segments of slabs coming from the relative continuous casting line.

In these rolling plants associated with at least two continuous casting machines one furnace is normally in-line and feeds the segments of slab to the rolling train, while the other furnace acts as a buffer store and maintains the temperature of the segments until they are sent to the rolling train.

In such a case, since the rolling train and continuous casting machine normally work at different speeds, interruptions of the feed to the rolling train take place between one segment of slab and the next one.

This fact not only entails a reduction of the yield of the whole plant but also involves the great risk of damage and wear to the rolling rolls owing to continuous alternate stresses arising from a very discontinuous processing.

Moreover, complex and bulky systems are required for the buffer store and for traversing so as to contain and to transfer the segments which gradually accumulate on the casting line acting as a buffer store at that moment.

Furthermore, the traditional plants include two distinct systems for feeding the molten metal to the mould, each system being equipped with its own ladle.

This involves a great overall bulk, the possibility of contacts between the two systems, less space for possible work to maintain and/or replace the components and also working difficulties connected with the discharge of the molten metal into the two different mould systems.

Another aspect which characterises the plants of the state of the art concerns the descaling systems included in-line.

The plants of the state of the art normally include descaling systems with stationary water walls positioned at the outlet of the temperature-maintaining and/or heating furnaces.

These embodiments not only entail a great waste of water but also are incapable of eliminating all the scale which forms on the surface of the products being rolled, especially in the normal case in which the scale formed consists mainly of hard oxides owing to the low speed of feed and the high temperature.

If the segment of slab entering the furnace has on its surface a great quantity of scale, the layer of scale increases considerably within the furnace and, in view of its content, is very difficult to remove.

SUMMARY OF THE INVENTION

The present applicants have designed, tested and embodied this invention so as to overcome, or at least to reduce partly, these shortcomings of the state of the art and to achieve further advantages.

The purpose of the invention is to embody for strip and/or plate a rolling line which achieves the twofold result of producing a product of a high surface and internal quality by means of a line characterised by high yield, flexibility, excellent use of the space available and of the overall bulk, and versatility.

The rolling line according to the invention comprises a casting machine having at least one line.

According to a variant, the casting machine has two lines working at the same time and being fed simultaneously.

According to this variant, the moulds of the two casting lines are fed at the same time by one single ladle equipped with relative conduits for discharge of the molten metal.

In this way the overall bulk of the casting machine is reduced; there is the security of the simultaneous progress of the casting and of the uniformity of the cast product and the uniformity of its temperature; and also the possible work of maintenance and/or replacement of the components of the casting machine is simplified.

A shears is included immediately downstream of the casting line and shears the cast slab into segments of a desired length, which are accelerated at once within the respective furnace systems performing heating and possible temperature-maintaining.

According to the invention fast heating means of an induction type, for instance, are included between the shears and the inlet of these furnace systems and are followed by a descaling means.

According to the invention the descaling means is of a rotary type with a high pressure of delivery so as to achieve a saving of the water delivered, while ensuring at the same time the effectiveness of the action and its uniformity over the whole surface of the slab.

According to the invention the furnace systems are of a type with independent modules having independent heating systems incorporated.

This situation enables the flexibility and versatility of these systems to be increased considerably according to the type of the cast product and according to the production rate.

Each of the modules forming these furnace systems has a length at least equal to that of the segments of slab prepared by the shears.

According to the variant of the invention the furnace systems included on each of the two casting lines have their last downstream module associated with a traversing system able to transfer the module to a position on the axis of the rolling train.

In particular, according to the invention, as soon as the segment has left the last downstream module of the furnace system and has been sent to a roughing rolling mill stand and thence to a finishing train, the last downstream modules of the furnace systems of the two lines, are exchanged for each other so as to position on the axis of the rolling train the module containing the segment of slab.

The speed of exchange of the last downstream modules of the furnace systems is synchronised with the casting rate and with the speed of acceleration so as to achieve an this way a substantially continuous feed to the rolling train.

The rolling line according to the invention comprises, downstream of these furnace systems, a descaling unit, a roughing rolling mill stand able to reduce the thickness of the slab to the most suitable value for the working of the finishing train, a further tunnel furnace performing at least temperature-maintaining and then the finishing train preceded by a further descaling unit.

The finishing train is then followed conventionally by a cooling conveyor and a winding unit.

The embodiment according to the invention not only optimises the yield and efficiency of the plant and increases its output but also enables the downtimes of the rolling rolls between one working cycle and another to be reduced and thus improves the yield of the rolls and reduces their wear.

BRIEF DESCRIPTION OF THE DRAWINGS

The attached FIGURE is given as a non-restrictive example and shows a rolling line that carries out the method according to the invention.

DETAILED DESCRIPTION OF THE PREFERRED EMBODIMENTS

A rolling line 10 according to the invention comprises in this case one single casting machine with two respective casting lines 11*a,* 11*b* which tend one single finishing train 12.

In this case, the two casting lines 11*a,* 11*b* include respective mould systems referenced with 13*a* and 13*b* and cooperating with one single discharge ladle unit 14, which feeds both mould systems 13*a*, 13*b* at the same time.

This embodiment makes possible a reduction of the overall bulk, optimises the use of space and ensures simultaneous casting and uniformity of the cast product and of its temperature.

Respective shears 15*a*, 15*b* are included downstream of the relative casting lines 11*a,* 11*b* and shear the cast slab to size in segments which are then accelerated and distanced apart downstream.

The shears 15*a*, 15*b* are followed by respective fast heating units 16*a*, 16*b*, which for instance are induction furnaces, and then by first respective descaling units 17*a*, 17*b*.

In this case, the first descaling units 17*a*, 17*b* are of a rotary type with a high pressure of delivery and carry out an efficient and uniform descaling action over the whole surface of the slab, at the same time achieving a saving in the quantity of water delivered.

In this example the delivery of water by each descaling unit 17*a*, 17*b* is between 11 and 20 cu.mts/hr.

The segments of slab are then sent into respective heating furnaces 18*a*, 18*b*, in which they are accelerated still more and are spaced apart.

In this case, the heating furnaces 18*a*, 18*b* consist of modules 19, which in this example are three in number and are independent of each other and incorporate heating systems.

These modules 19 are set in communication with each other by means of doors which can be opened at the ends of each module.

Each heating furnace 18*a*, 18*b* may also comprise four or more of the modules 19, each of which has a length at least equal to, but advantageously slightly greater than, the length of each segment of slab sheared to size.

In this case, the last downstream modules, respectively 19*a* and 19*b*, of the relative heating furnaces 18*a*, 18*b* can be moved and are associated with a traversing and transfer system 20 which enables them to be positioned alternately in a position aligned with the finishing train 12, thus achieving a continuous exchange of feed of the segments between the two casting lines 11*a,* 11*b*.

This exchange is started as soon as the segment held within the last downstream module 19*a*, 19*b* aligned at that moment with the finishing train 12 has left that module 19*a*, 19*b* and has been forwarded for the roughing rolling process and then for the finishing process.

In this way the downtimes in the feed to the finishing train 12 are considerably reduced, thus obtaining a more rational exploitation of the rolling line 10 and at the same time reducing the wear on the rolling rolls.

The segments are sent to a descaling step carried out by a second descaling unit 21 and thereafter are delivered into a roughing rolling mill stand 22.

The second descaling unit 21 is of a traditional type with stationary water walls and with a delivery of water between about 300 and about 400 cu.mts/hr.

The roughing rolling mill stand 22, which may or may not be preceded by a rolling mill stand 23 processing the edges of the slab, has the purpose of reducing the thickness of the slabs to a more correct value for an efficient working of the processing rolls of the finishing train 12.

This value of the thickness is advantageously between about 30 and about 45 mm., thus eliminating the problems of entry into the rolling passes and of overheating of the rolls of the finishing train 12.

The segment is then sent into a tunnel furnace 24 performing heating and temperature-equalisation and is then rolled in the finishing train 12, with six rolling passes in this case.

The strip or plate thus produced is then sent to a cooling zone 25 and thereafter is wound in winding units 26.

In this case a third descaling unit 27 of a type substantially analogous to, and performing a delivery substantially analogous to that of, the second descaling unit 21 is included downstream of the tunnel furnace 24 and in a position immediately upstream of the finishing train 12.

A cropping shears 28 may possibly be included upstream of the third descaling unit 27.

We claim:

1. Method to roll strip and plate starting from thin slabs produced by continuous casting, comprising: continuously casting a thin slab by a continuous casting machine with at least one casting line, shearing the thin slab to obtain segments of a desired size, descaling the segments in a first descaling step, then delivering the segments into a heating furnace comprising a plurality of modules, each of the modules having a length at least equal to a length of the segments, heating the segments in the heating furnace, then sending the segments to a second descaling unit, descaling the segments in the second descaling unit, then sending the segments through and rolling the segments in a roughing rolling mill stand, and then delivering the segments to a tunnel furnace, heating the segments in the tunnel furnace, descaling the segments in a third descaling unit and finishing the segments in a finishing train.

2. Method as in claim 1, wherein the casting machine has two parallel casting lines and wherein the method comprises feeding the two parallel casting lines at the same time so as to obtain thin slabs at the same time, feeding the segments of the thin slabs, before reaching the second descaling unit, to a traversing and transfer system, cooperating with movable parallel end modules of the heating furnace, and positioning the end modules of the traversing and transfer system in an alternate sequence on the same axis as the roughing and finishing line.

3. Method as in claim 1, further comprising performing a fast heating step immediately before the first descaling step.

4. Method as in claim 1, wherein the first descaling step is carried out by first descaling units of a rotary type delivering jets of water at a high pressure and with a delivery of between 11 and 20 cu.mts/hr.

5. Method as in claim 2, wherein a speed of exchange of the two last downstream movable modules of the heating furnaces for each other is synchronised at least with a speed of acceleration of the segments of slab within the heating furnaces and with a rate of casting.

6. Method as in claim 1, further comprising winding the segments downstream of the finishing train.

7. Method as in claim 1, wherein the second and third descaling units are of a type delivering stationary water walls with a delivery of between about 300 and about 400 cu.mts/hr.

8. Method as in claim 1, further comprising performing a step of processing the edges of the segments of slab before rolling the segments in the roughing rolling mill stand.

9. Method as in claim 1, wherein the segments of slab have a thickness between about 30 and about 45 mm. at an outlet of the roughing rolling mill stand.

10. Method as in claim 1, wherein the finishing step comprises rolling the segments in six rolling passes.

11. Method as in claim 1, wherein the at least one casting line is fed by a ladle system cooperating with a mould system of the at least one casting line.

12. Method as in claim 1, further comprising accelerating and spacing apart the segments on the heating furnace.

* * * * *